US011169471B2

(12) United States Patent
Aoshima et al.

(10) Patent No.: US 11,169,471 B2
(45) Date of Patent: Nov. 9, 2021

(54) DRIVE FOR BELT

(71) Applicant: HEWLETT-PACKARD DEVELOPMENT COMPANY, L.P., Spring, TX (US)

(72) Inventors: Yuji Aoshima, Yokohama (JP); Kensuke Nakajima, Yokohama (JP); Satoru Hori, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/051,331

(22) PCT Filed: Jun. 18, 2019

(86) PCT No.: PCT/US2019/037693
§ 371 (c)(1),
(2) Date: Oct. 28, 2020

(87) PCT Pub. No.: WO2020/018217
PCT Pub. Date: Jan. 23, 2020

(65) Prior Publication Data

US 2021/0072671 A1 Mar. 11, 2021

(30) Foreign Application Priority Data

Jul. 18, 2018 (JP) ..... JP2018-135246

(51) Int. Cl.
*G03G 15/20* (2006.01)
*G03G 15/16* (2006.01)
*B65H 5/02* (2006.01)

(52) U.S. Cl.
CPC ..... *G03G 15/1615* (2013.01); *B65H 5/025* (2013.01)

(58) Field of Classification Search
CPC ..... G03G 2215/00156; B65H 5/025
(Continued)

(56) References Cited

U.S. PATENT DOCUMENTS 9,465,347 B2 * 10/2016 Hagiwara ..... G03G 15/6529
10,216,133 B2 * 2/2019 Hayakawa ..... G03G 15/55
(Continued)

FOREIGN PATENT DOCUMENTS

EP 3196036 7/2017
JP H05149395 A 6/1993
(Continued)

*Primary Examiner* — Hoan H Tran
(74) *Attorney, Agent, or Firm* — Staas & Halsey LLP

(57) ABSTRACT

A belt driving device includes: an endless belt; a stretch roller to engage the endless belt, the stretch roller including a rotary shaft; a steering roller spaced apart from the stretch roller within the endless belt; an adjustment member located along the rotary shaft of the stretch roller, the adjustment member movable along the rotary shaft; and linking mechanism to couple the adjustment member to the steering roller, the linking mechanism to engage a contact surface of the adjustment member. The contact surface includes contact points positioned at different distances from the rotary shaft to raise the linking mechanism during movement of the adjustment member, to cause the steering roller to tilt at an angle, and to maintain an alignment of the endless belt.

15 Claims, 12 Drawing Sheets

(58) Field of Classification Search
USPC ..... 399/162, 165, 167, 308
See application file for complete search history.

(56) References Cited

U.S. PATENT DOCUMENTS

| | | | | |
|---|---|---|---|---|
| 10,635,029 | B2 * | 4/2020 | Kurosu | G03G 15/1665 |
| 2011/0293336 | A1 | 12/2011 | Noso | |
| 2012/0121295 | A1 | 5/2012 | Tsuji | |
| 2014/0054139 | A1 | 2/2014 | Ogata | |

FOREIGN PATENT DOCUMENTS

| | | | |
|---|---|---|---|
| JP | 1996248859 | | 9/1996 |
| JP | 2002162811 | | 6/2002 |
| JP | 2007079399 | A | 3/2007 |
| JP | 2008112092 | | 5/2008 |
| JP | 2008215563 | | 9/2008 |
| JP | 2011027243 | | 2/2011 |
| JP | 2013076886 | | 4/2013 |
| JP | 2015206889 | | 11/2015 |
| JP | 2016009161 | | 1/2016 |
| JP | 2018072558 | | 5/2018 |
| RU | 1223195 | A1 | 4/1986 |
| RU | 1313768 | A1 | 5/1987 |

* cited by examiner

DRIVE FOR BELT

CROSS REFERENCE TO RELATED APPLICATIONS

This application is filed under 35 U.S.C. 0.371 as a National Stage of PCT International Application No. PCT/US2019/037693, filed on Jun. 18, 2019, in the U.S. Patent and Trademark Office, which claims the priority benefit of Japanese Patent Application No. 2018-135246, filed on Jul. 18, 2018, in the Japanese Patent Office. The disclosures of PCT International Application No. PCT/US2019/037693 and Japanese Patent Application No. 2018-135246 are incorporated by reference herein in their entireties.

BACKGROUND

In some imaging devices, an endless belt is used as an intermediate transfer belt for performing secondary transfer of toner, for example. The endless belt engages with a stretch roller and is driven along a circling orbit. When the endless belt moves in a longitudinal direction of the stretch roller, a steering roller disposed on an inner side of the endless belt tilts, and thereby the disposition of the endless belt is corrected.

DETAILED DESCRIPTION

Figure 1:
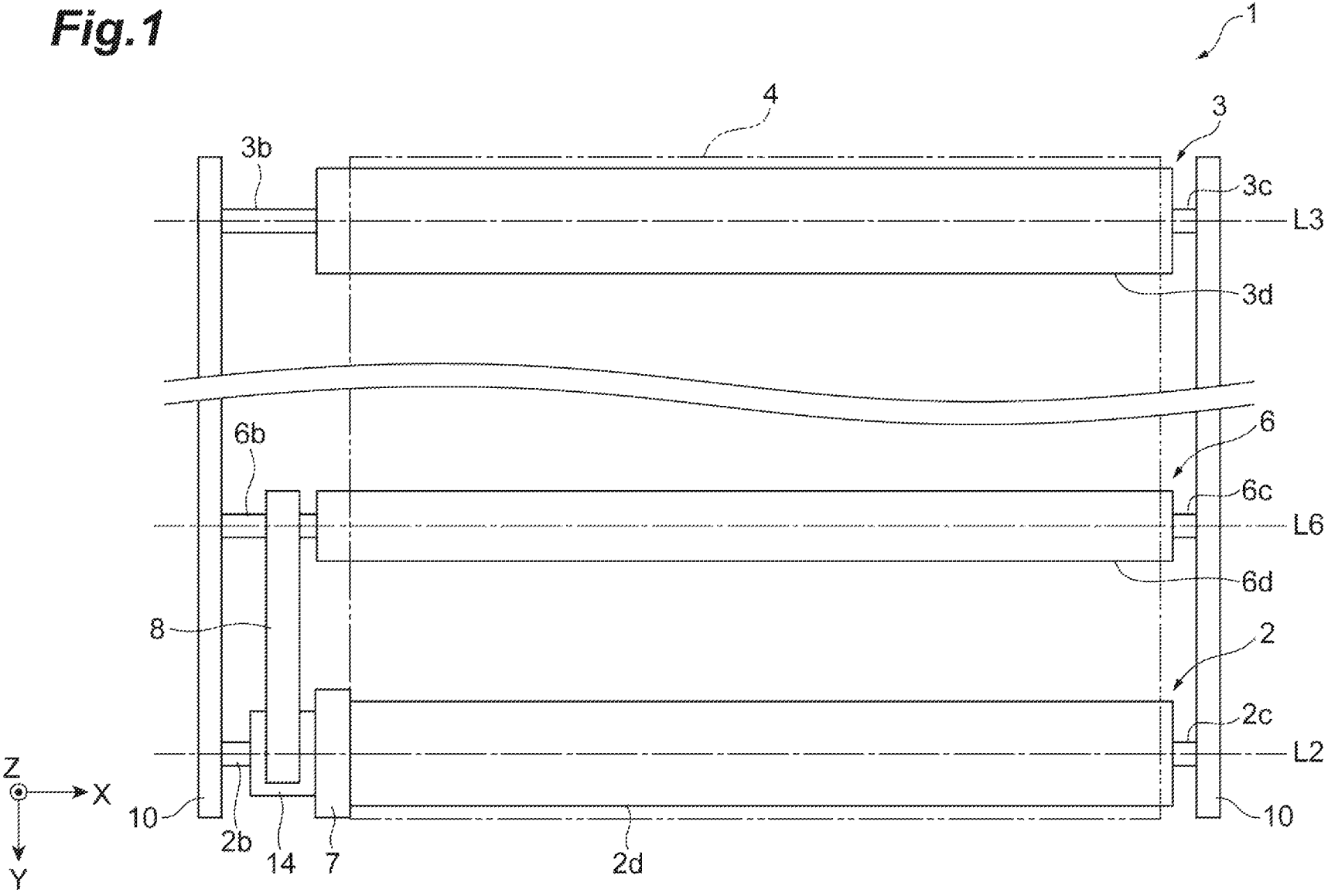
FIG. 1 is a plan view illustrating an example belt driving device.

In the following description, with reference to the drawings, the same reference numbers are assigned to the same components or to similar components having the same function, and overlapping description is omitted. In some examples, reference is provided to an XYZ orthogonal coordinate system illustrated in the drawings. Where an X direction is set as a width direction, a central side may be described as an inner side of an example belt driving device and an end side may be described as an outer side of the belt driving device. In addition, a Y direction may be described as a front-rear direction of the belt driving device and a Z direction may be described as a vertical direction of the belt driving device.

FIG. 1 is a schematic plan view illustrating an example belt driving device 1 for an imaging apparatus. The imaging apparatus may be a printer, a component of an imaging system, or an imaging system. For example, the imaging apparatus may comprise a developing device used in an imaging system or the like. A belt driving device 1 includes an endless belt 4, stretch rollers 2 and 3, a steering roller 6, an adjustment member 14, and a linking mechanism 8. For example, the belt driving device 1 can be used as a transfer unit that performs secondary transfer of a toner image developed by a developing unit to a sheet in an image forming apparatus such as a printer. In the transfer unit, the endless belt 4 can function as an intermediate transfer belt. In addition, the belt driving device 1 can be used as a sheet transport unit that transports a sheet. In the sheet transport unit, the endless belt 4 can function as a sheet transport belt.

In some examples, the endless belt 4 is disposed across the stretch roller 2 disposed at an end in the Y direction and the stretch roller 3 disposed at the other end in the Y direction. The belt driving device 1 may further include another stretch roller that stretches the endless belt 4. The stretch roller 2 and the stretch roller 3 extend in the X direction and are disposed to be opposite to each other in the Y direction intersecting the X direction. In some examples, a direction intersecting the X direction and the Y direction is set as the Z direction. The stretch roller 2 has a cylindrical roller main body 2*d* that engages with the endless belt 4 and rotary shafts 2*b* and 2*c* projecting from the roller main body 2*d* along the X direction, on an inner side of the endless belt 4. The stretch roller 3 has a cylindrical roller main body 3*d* that engages with the endless belt 4 and rotary shafts 3*b* and 3*c* projecting from the roller main body 3*d* along the X direction, on the inner side of the endless belt 4.

The stretch roller 2 rotates around an axis line L2 along the X direction and may be powered by an electric motor. The endless belt 4 moves along a circling orbit in response to rotation of the stretch roller 2. The stretch roller 3 rotates around an axis line L3 in response to the movement of the endless belt 4. A bearing that supports the stretch rollers 2 and 3 is supported at both sides in the X direction by a frame 10 extending in the Y direction. The power from the electric motor may not be transmitted to the stretch roller 2 but to the stretch roller 3. In some examples, the endless belt 4 moves in a circle in response to rotation of the stretch roller 3, and the stretch roller 2 rotates in response to rotating movement of the endless belt 4.

The steering roller 6 is disposed at a position that is spaced apart from the stretch roller 2 on the inner side of the endless belt 4. In some examples, the steering roller 6 is disposed between the stretch roller 2 and the stretch roller 3 in the Y direction, such that the steering roller 6 is disposed at a position closer to the stretch roller 2 than to the stretch roller 3 in the Y direction. The steering roller 6 is disposed to abut an inner peripheral surface 4*a* (refer to FIG. 2) of the endless belt 4 that moves from the stretch roller 3 toward the stretch roller 2.

The steering roller 6 has a cylindrical roller main body 6*d* that abuts the endless belt 4 and rotary shafts 6*b* and 6*c* projecting from the roller main body 6*d* along the X direction, on the inner side of the endless belt 4. The steering roller 6 is rotatably driven around the axis line L6 in response to the circling movement of the endless belt 4. A bearing that supports the rotary shafts 6*b* and 6*c* of the steering roller 6 is supported by the frame 10. A position of one rotary shaft 6*b* of the steering roller 6 is displaceable in the Z direction. The position of the rotary shaft 6*b* is displaced in the Z direction, and thereby the steering roller 6 can tilt with a side of the rotary shaft 6*c* as a fulcrum. The operating mechanism of the tilting of the steering roller 6 may be performed by various mechanisms. For example, the steering roller may tilt with the center in the Y direction as the fulcrum.

The adjustment member 14 is disposed along the rotary shaft 2*b* of the stretch roller 2 outside the roller main body 2*d* in the X direction. The adjustment member 14 is movable in the X direction along the rotary shaft 2*b*. As illustrated in FIG. 1, a pulley 7 (an example of a positioning member) may be disposed between the adjustment member 14 and the roller main body 2*d* of the stretch roller 2 in the X direction.

Figure 2:
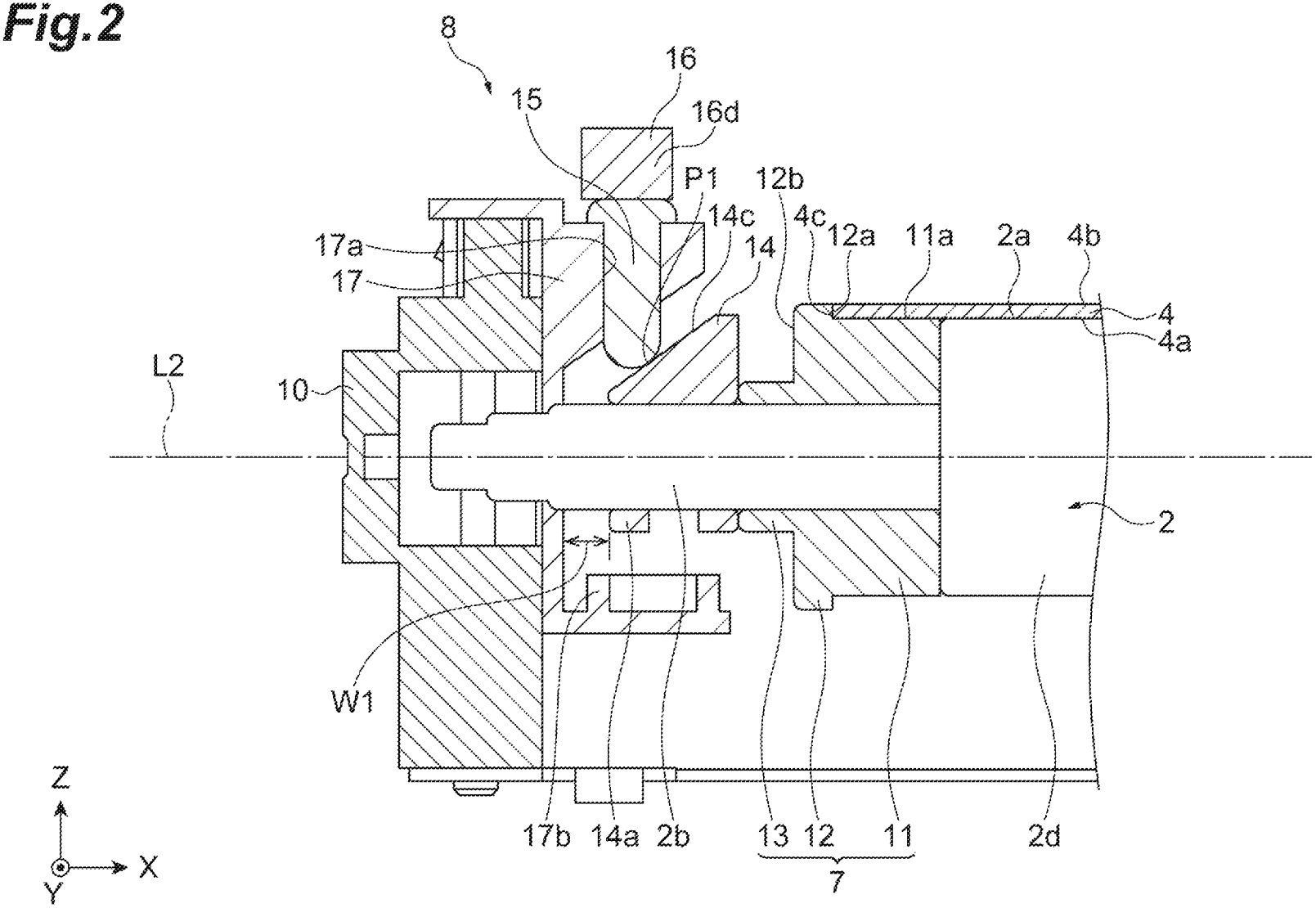
FIG. 2 is a sectional view illustrating an example end structure of a stretch roller.
Figure 3:
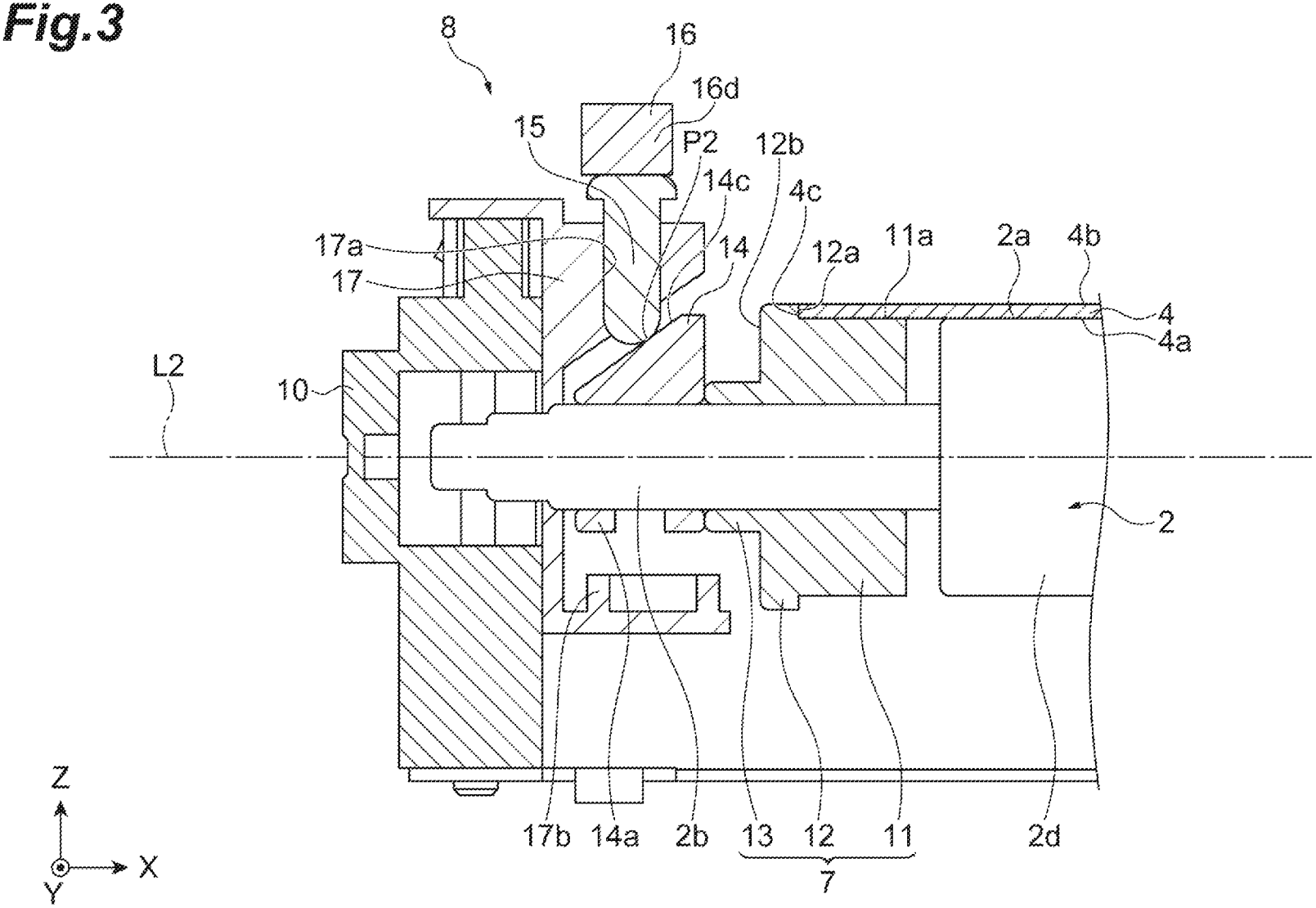
FIG. 3 is a sectional view illustrating another example end structure of the stretch roller.

FIGS. 2 and 3 are sectional views illustrating an example end structure of the stretch roller 2. FIGS. 2 and 3 illustrate sections of the belt driving device 1 along an XZ plane at a position of the axis line L2. As illustrated in FIGS. 2 and 3, the rotary shaft 2*b* of the stretch roller 2 is inserted into the pulley 7. The pulley 7 has a cylindrical portion 11, a flange portion 12, and a small-diameter portion 13. The pulley 7 is movable in the direction along the rotary shaft 2*b*. An outer diameter of the rotary shaft 2*b* of the stretch roller 2 is smaller than an outer diameter of the roller main body 2*d* of the stretch roller 2. A length of the roller main body 2*d* of the stretch roller 2 in the X direction is slightly smaller than a width (length in the X direction) of the endless belt 4. An outer diameter of the cylindrical portion 11 is substantially equal to the outer diameter of the roller main body 2*d* of the stretch roller 2. An outer peripheral surface 11*a* of the cylindrical portion 11 and an outer peripheral surface 2*a* of the roller main body 2*d* of the stretch roller 2 are disposed substantially at the same position from the axis line L2 in a radial direction of the stretch roller 2. The outer peripheral surface 11*a* of the cylindrical portion 11 is configured to abut the inner peripheral surface 4*a* of the endless belt 4.

The flange portion 12 protrudes more outward in the radial direction across the entire circumference than the outer peripheral surface 11*a* of the cylindrical portion 11. Additionally, the flange portion 12 protrudes more to an outer side in the radial direction than the outer peripheral surface 4*b* of the endless belt 4. An inner surface 12*a* of the flange portion 12 is opposite to an end surface 4*c* of the endless belt 4 in the X direction and is configured to abut the end surface 4*c*. The inner surface 12*a* of the flange portion 12 faces toward an inner side of the belt driving device 1 in a direction in which the axis line L2 of the stretch roller 2 extends and additionally faces a side of the endless belt 4. An outer surface 12*b* of the flange portion 12 is a surface toward an outer side of the belt driving device 1 in a direction in which the axis line L2 extends and is a surface on a side of the bearing. The small-diameter portion 13 is a cylindrical portion having a diameter smaller than the cylindrical portion 11 and projects to the outer side in the X direction.

The adjustment member 14 is disposed further on the outer side than the pulley 7 in the X direction. The rotary shaft 2*b* of the stretch roller 2 is inserted into the adjustment member 14. The adjustment member 14 moves to the outer side in the X direction in response to the movement of the pulley 7. The adjustment member 14 illustrated in the drawing has a main body portion 14*a* provided with an opening portion into which the rotary shaft 2*b* is inserted. A top surface of the main body portion 14*a* is formed as an inclined surface 14*c* (an example of a contact surface). The inclined surface 14*c* is inclined to be spaced apart from the axis line L2 from the outer side toward the inner side in the X direction. In some examples, the inclined surface 14*c* is formed to ascend from the outer side toward the inner side in the X direction. Accordingly, when the adjustment member 14 moves to the outer side in the X direction, a member that is in contact with the inclined surface 14*c* is pushed upward.

Figure 4:
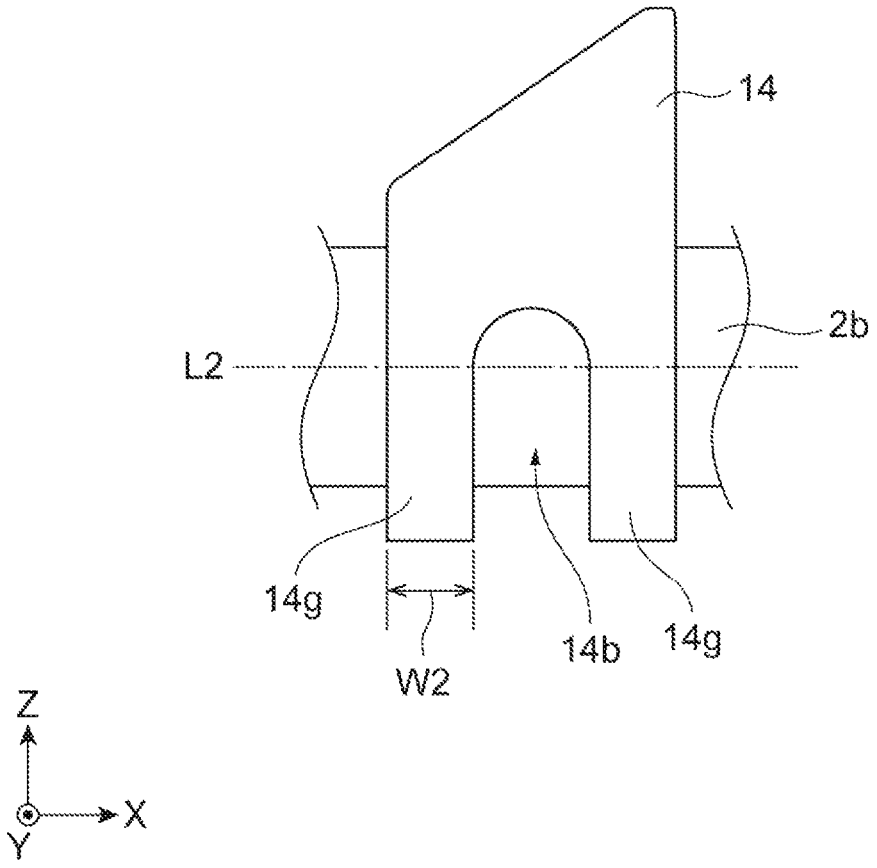
FIG. 4 is a side view illustrating an example adjustment member.
Figure 5:
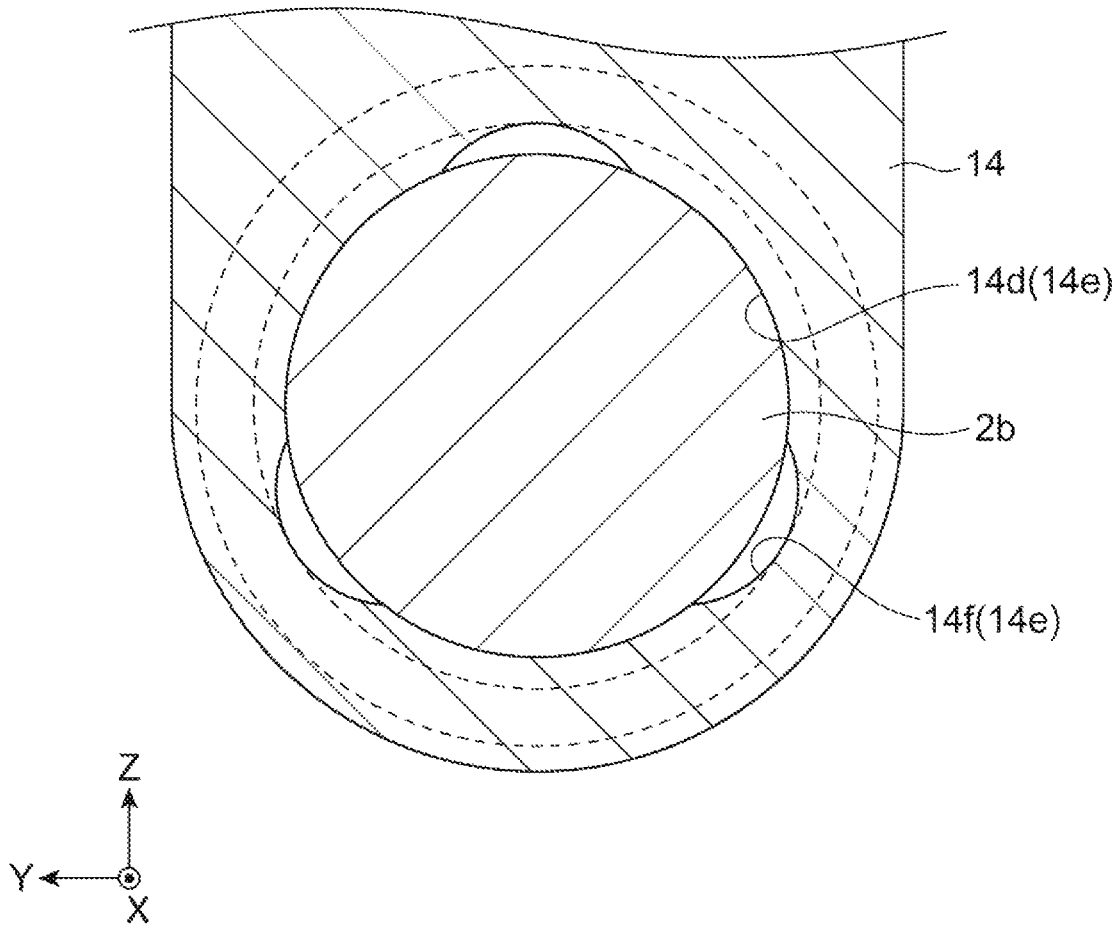
FIG. 5 is a sectional view illustrating an example bearing part of the adjustment member.
Figure 6:
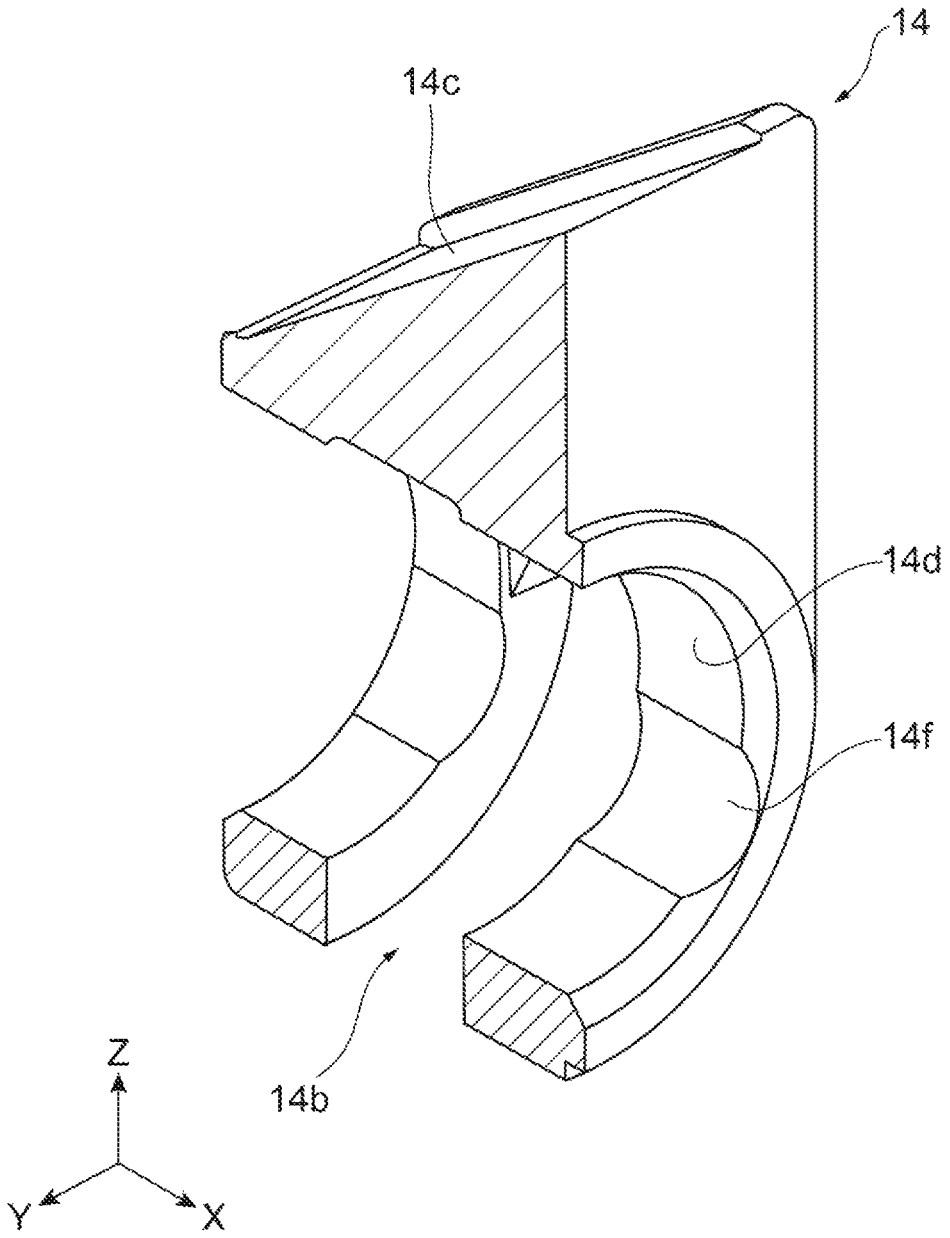
FIG. 6 is a sectional perspective view of the example adjustment member.

FIG. 4 is a side view illustrating the adjustment member according to an example. FIG. 4 illustrates a side view of the adjustment member 14 in a state in which the rotary shaft 2*b* is inserted into the adjustment member. FIG. 5 is a sectional view illustrating an example bearing part of the adjustment member. FIG. 5 illustrates a section of the adjustment member 14 along a YZ plane. FIG. 6 is a sectional perspective view of the adjustment member according to an example. FIG. 6 illustrates a section of the adjustment member 14 along the XZ plane.

As illustrated in FIGS. 4, 5, and 6, the example adjustment member 14 is provided with a slit 14*b* which exposes at least a part of the rotary shaft 2*b* inserted into the main body portion 14*a*. The slit 14*b* extends in a direction intersecting the axis line L2 of the rotary shaft 2*b*. In some examples, the slit 14*b* is formed at a part in a circumferential direction along a circumferential direction of the rotary shaft 2*b* such that a lower side of the rotary shaft 2*b* in a vertical direction is exposed. The slit 14*b* can function as a discharge port for discharging foreign matter between the rotary shaft 2*b* and the adjustment member 14. In some examples, a part of the rotary shaft 2*b* on the lower side in the vertical direction is exposed, and thereby the foreign matter is easily dropped to the lower side.

In some examples, a collecting portion 17*b* is formed below the adjustment member 14 and is opened toward the slit 14*b*. When the foreign matter between the rotary shaft 2*b* and the adjustment member 14 is discharged from the slit 14*b*, the foreign matter can be collected in the collecting portion 17*b*. The collecting portion 17*b* may be integrally formed with a case or may be formed as a separate body from the case.

As illustrated in FIG. 5, an inner surface of the opening portion in the main body portion 14*a* of the adjustment member 14 is a bearing surface 14*e* that surrounds the rotary shaft 2*b*. The bearing surface 14*e* is provided with a support surface 14*d* that is configured to make contact with the rotary shaft 2*b* and a recessed surface 14*f* that is spaced apart from the rotary shaft 2*b*. The example support surface 14*d* has an arc shape around the axis line of the rotary shaft 2*b* when viewed from a rotary shaft direction. The recessed surface 14*f* is a surface formed to have a longer distance from the axis line of the rotary shaft 2*b* than the support surface 14*d*. When the rotary shaft 2*b* is inserted into the opening portion, a gap is formed between the recessed surface 14*f* and the rotary shaft 2*b*. When viewed from an axial line direction, positions of some recessed surfaces 14*f* overlap the position of the slit 14*b*. Additionally, the recessed surfaces 14*f* may be formed at equal intervals at three positions in the circumferential direction.

A movable length W1 (refer to FIG. 2) of the adjustment member 14 in a longitudinal direction of the stretch roller 2 may be longer than a width W2 (refer to FIG. 4) of a frame portion 14*g* that surrounds the slit 14*b* in the adjustment member 14. In some examples, a part of the main body portion 14*a*, which forms a peripheral edge of the slit 14*b*, constitutes the frame portion 14*g* that surrounds the slit 14*b*. In addition, a distance from a side surface of the adjustment member 14 in the X direction to a side surface of a holding member 17 (described in further detail below) is the movable length W1 of the adjustment member 14.

The linking mechanism 8 couples the adjustment member 14 and the steering roller 6 in order to transmit motion of the adjustment member 14 to the steering roller 6. The linking mechanism 8 may include a pin 15 and a link member 16.

The pin 15 has a circular column shape and extends in the Z direction. The pin 15 is held by the holding member 17 fixed to the frame 10. Additionally, the frame and the holding member may be integrally molded. The holding member 17 is provided with an opening portion 17*a* extending in the Z direction. The pin 15 is held in a state in which the pin is inserted into the opening portion 17*a*. The pin 15 is held by the holding member 17 so as to be movable in the Z direction. In addition, an upper end portion of the pin 15 is provided with a collar portion that protrudes in a radial direction of the pin 15. The collar portion abuts a peripheral edge portion of the opening portion 17*a* such that the pin 15 is prevented from falling. A lower end portion of the pin 15 is formed as a hemispherical surface, for example. The lower end portion of the pin 15 projects downward from the opening portion 17*a* and abuts the inclined surface 14*c* of the adjustment member 14. Positions of contact points P1 and P2 (refer to FIGS. 2 and 3) with the pin 15 on the inclined surface 14*c* are displaced in response to movement of the holding member in the X direction. In some examples, a plurality of contact points P1 and P2 are positioned at different distances from the axis line L2 of the rotary shaft 2*b*. Therefore, the pin 15 is lifted or lowered in response to the movement of the adjustment member 14 in the X direction.

Figure 7:
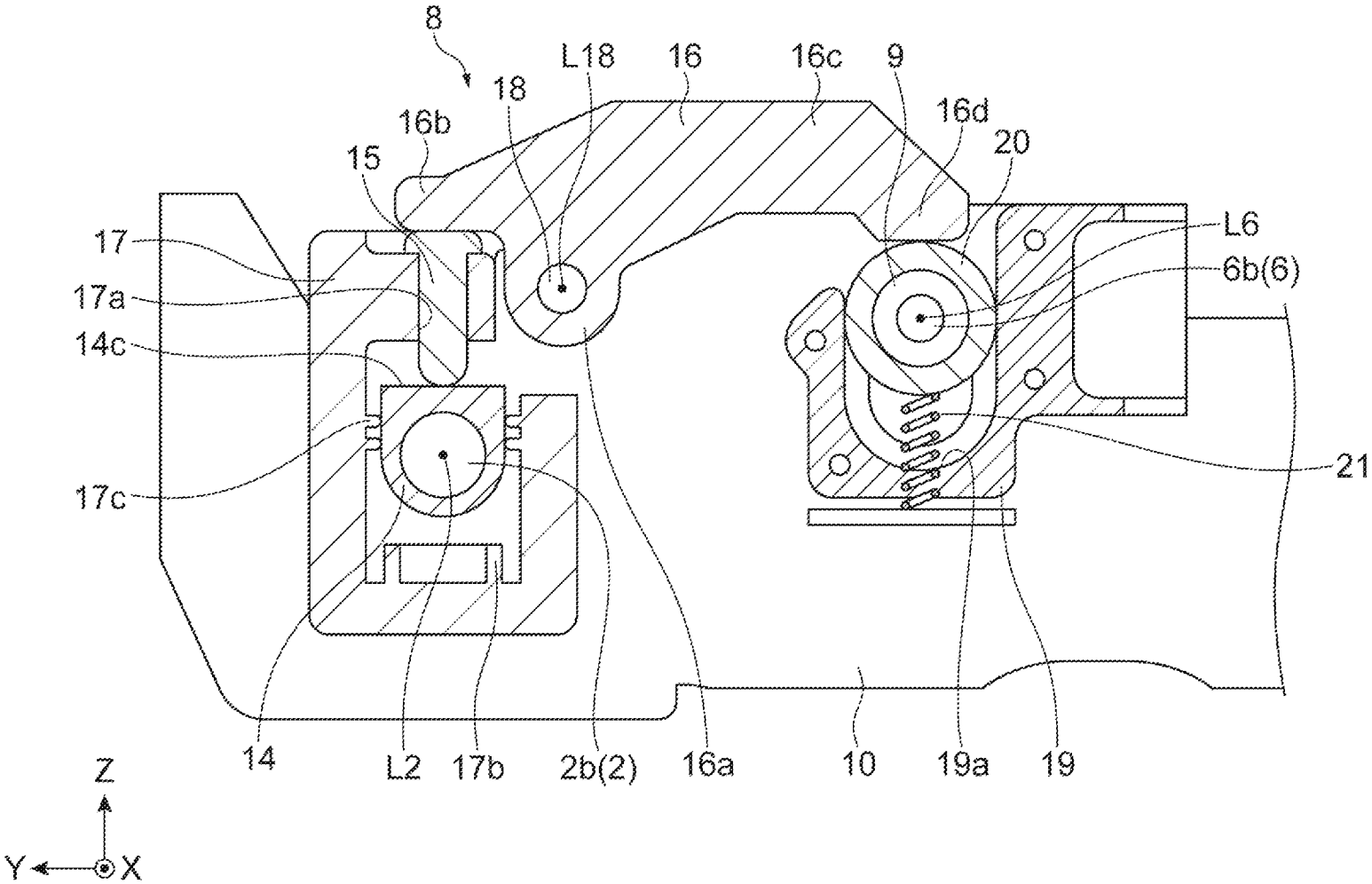
FIG. 7 is a sectional view illustrating yet another example end structure of the stretch roller.

FIG. 7 is a sectional view illustrating an example end structure of the stretch roller 2. FIG. 7 illustrates a section of the belt driving device 1 along the YZ plane at an end portion (position at which the pin 15 is cut) of the rotary shaft 2*b*. As illustrated in FIG. 7, the holding member 17 is provided with a pair of support projections 17*c* that regulates rotation of the adjustment member 14. In some examples, the pair of support projections 17*c* is continuously formed in the X direction and is provided at positions of supporting the adjustment member 14 from both sides in the Y direction. In the example end structure illustrated in FIG. 7, the pair of support projections 17*c* includes two projections which are vertically separated from each other; however, the support projection is not limited thereto.

As illustrated in FIG. 7, the link member 16 is provided with a fulcrum portion 16*a*, a reception portion 16*b*, a continuous portion 16*c*, and a pressing portion 16*d*. The fulcrum portion 16*a* is supported by the support shaft 18 fixed to the frame 10. The support shaft 18 is disposed between the stretch roller 2 and the steering roller 6 in the Y direction and extends in the X direction. The fulcrum portion 16*a* is provided with an opening portion into which the support shaft 18 is inserted, and the support shaft 18 is inserted into the opening portion. The fulcrum portion 16*a* is rotatable around the support shaft 18.

The reception portion 16*b* is connected to the fulcrum portion 16*a* and protrudes to the outer side in the Y direction. The reception portion 16*b* extends to a position at which the reception portion is configured to abut the upper end portion of the pin 15. The reception portion 16*b* abuts the upper end portion of the pin 15. A height position of the reception portion 16*b* is displaced in response to the movement of the pin 15 in the Z direction. When the pin 15 moves upward, the reception portion 16*b* moves upward in linkage with the pin.

The continuous portion 16*c* is connected to the fulcrum portion 16*a* and extends to the inner side in the Y direction. The continuous portion 16*c* extends to a side opposite to the reception portion 16*b* in the Y direction. Additionally, the continuous portion 16*c* extends to a position above the rotary shaft 6*b* of the steering roller 6. The continuous portion 16*c* oscillates in response to rotation of the fulcrum portion 16*a*. The pressing portion 16*d* is provided at a distal end of the continuous portion 16*c*. The pressing portion 16*d* has a surface that abuts an outer peripheral surface of a bearing accommodating portion 20 that accommodates a bearing 9. When the continuous portion 16*c* oscillates, the pressing portion 16*d* moves downward and presses the bearing accommodating portion 20 so as to press the bearing 9 and the rotary shaft 6*b* of the steering roller 6 downward.

As illustrated in FIG. 7, the bearing accommodating portion 20 that accommodates the bearing 9 which supports the rotary shaft 6*b* is supported by a spring member (first spring member) 21 with respect to the frame 10. The spring member 21 extends in the Z direction and supports the bearing accommodating portion 20 from below. A lower end portion of the spring member 21 is supported by a connector 19 fixed to the frame 10. An upper end portion of the spring member 21 is connected to the bearing accommodating portion 20. The spring member 21 extends and contracts in the Z direction and biases the bearing accommodating portion 20 upward.

The connector 19 is provided with an accommodation portion 19*a* that holds the bearing accommodating portion 20. The accommodation portion 19*a* is a recessed portion that is recessed downward, and wall surfaces of the recessed portion which are opposite to each other in the Y direction abut the bearing accommodating portion 20 so as to regulate a movement direction of the bearing accommodating portion 20. In addition, a bottom surface of the recessed portion is configured to abut the bearing accommodating portion 20 and limits a downward movement range of the bearing accommodating portion 20.

Next, an example operation of the belt driving device 1 will be described. Power is transmitted to the endless belt 4 by the stretch roller 2 such that the endless belt 4 moves in a circle. The stretch roller 3 rotates in response to the movement of the endless belt 4. In addition, the steering roller 6 rotates in response to the movement of the endless belt 4.

As illustrated in FIG. 3, when the position of the endless belt 4 shifts to the outer side in the width direction, that is, to the side of the rotary shaft 2*b*, the end surface 4*c* of the endless belt 4 presses the inner surface 12*a* of the flange portion 12 of the pulley 7. When the pulley 7 is pressed by the endless belt 4, the pulley 7 moves to the outer side. The adjustment member 14 is pressed by the pulley 7 and moves to the outer side in the X direction. The pin 15 is pushed upward by the inclined surface 14*c* in response to the movement of the adjustment member 14. When the pin 15 is displaced upward, the reception portion 16*b* of the link member 16 is pushed upward such that the link member 16 oscillates around an axis line L18.

Consequently, the pressing portion 16*d* is displaced downward such that the bearing accommodating portion 20 is pushed downward. The rotary shaft 6*b* of the steering roller 6 moves downward such that the steering roller 6 tilts.

When the steering roller 6 tilts, tension of the endless belt 4 is reduced more on the side of the rotary shaft 6*b* as compared to on the side of the rotary shaft 6*c*. As a result, the endless belt 4 moves to the side of the rotary shaft 6*c* in the width direction of the endless belt such that a misalignment of the endless belt 4 is corrected. When the endless belt 4 moves to the side of the rotary shaft 6*c*, a force of the endless belt 4 for pushing the pulley 7 to the outer side in the X direction is reduced. In this respect, since the spring member 21 biases and pushes the bearing accommodating portion 20 upward, the bearing 9 and the rotary shaft 6*b* move upward, and the pressing portion 16*d* of the link member 16 moves upward. This motion causes the reception portion 16*b* to move downward such that the pin 15 is pushed downward. The pin 15 that abuts the inclined surface 14*c* moves downward, and thereby the adjustment member 14 moves to the inner side in the X direction. The pulley 7 is pushed back by the adjustment member 14, as illustrated in FIG. 2, so as to return to an original position.

In some examples, the pulley 7 and the adjustment member 14 are moved in the X direction in response to the movement of the endless belt 4 in the width direction, and the pin 15 is lifted. In this manner, the link member 16 is driven such that the steering roller 6 may be tilted to correct the movement of the endless belt 4 in the width direction.

Since the misalignment of the endless belt 4 in the width direction is corrected, an occurrence of belt walk of the endless belt 4 may be suppressed or avoided. In some examples, an occurrence of deformation (for example, waviness) of the endless belt 4 due to variations in stretching force of the endless belt 4 may be suppressed. In an intermediate transfer unit including the belt driving device 1, the uniformity of an image that is transferred on the endless belt 4 may therefore be maintained.

In some examples, foreign matter is considered to intrude from a gap formed between contact surfaces of the pulley 7 and the adjustment member 14, and the foreign matter is considered to intrude between the rotary shaft 2*b* and the bearing surface 14*e* of the adjustment member 14. When the belt driving device 1 is used as the intermediate transfer unit, for example, a toner material used in the intermediate transfer unit can intrude as foreign matter. When foreign matter enters a space between the rotary shaft 2*b* and the bearing surface 14*e* of the adjustment member 14, relative rotational motion between the rotary shaft 2*b* and the adjustment member 14 is considered to be hindered. In addition, the movement of the adjustment member 14 in an axial direction with respect to the rotary shaft 2*b* is considered to be hindered.

The example adjustment member 14 is provided with the slit 14*b* through which at least a part of the rotary shaft 2*b* is exposed. Foreign matter that enters the space between the rotary shaft 2*b* and the bearing surface 14*e* of the adjustment member 14 can be discharged to the outside via the slit 14*b*. The intruding foreign matter is discharged from the slit 14*b*, and thereby accumulation of foreign matter between the rotary shaft 2*b* and the bearing surface 14*e* of the adjustment member 14 is suppressed.

The slit 14*b* causes at least a part of the rotary shaft 2*b* on a lower side in a vertical direction to be exposed. Since the foreign matter discharged from the slit 14*b* is dropped downward, re-intrusion of the discharged foreign matter from the slit 14*b* to the space between the rotary shaft 2*b* and the bearing surface 14*e* is suppressed.

In some examples, the collecting portion 17*b* is formed below the adjustment member 14 and is opened toward the slit 14*b* to accumulate foreign matter discharged from the slit 14*b* in the collecting portion 17*b*. Consequently, dispersion of foreign matter may be suppressed.

In the example adjustment member 14, the bearing surface 14*e* may be provided with the support surface 14*d* that is in contact with the rotary shaft 2*b* and the recessed surface 14*f* that is spaced apart from the rotary shaft 2*b*. Foreign matter intruding between the rotary shaft 2*b* and the support surface 14*d* may move easily between the rotary shaft 2*b* and the recessed surface 14*f* in response to the rotation of the rotary shaft 2*b*. Since a gap is formed between the rotary shaft 2*b* and the recessed surface 14*f*, an operation of the rotary shaft 2*b* is unlikely to be hindered even when the foreign matter is accumulated.

The movable length W1 of the adjustment member 14 in the longitudinal direction of the stretch roller 2 is longer than the width W2 of the frame portion 14*g* that surrounds the slit 14*b* in the adjustment member 14. In some examples, a range in which the rotary shaft 2*b* is covered with the frame portion 14*g* moves relatively in response to the movement of the adjustment member 14 in the longitudinal direction of the stretch roller 2. Therefore, the foreign matter intruding between the frame portion 14*g* and the rotary shaft 2*b* is effectively discharged.

Figure 8:
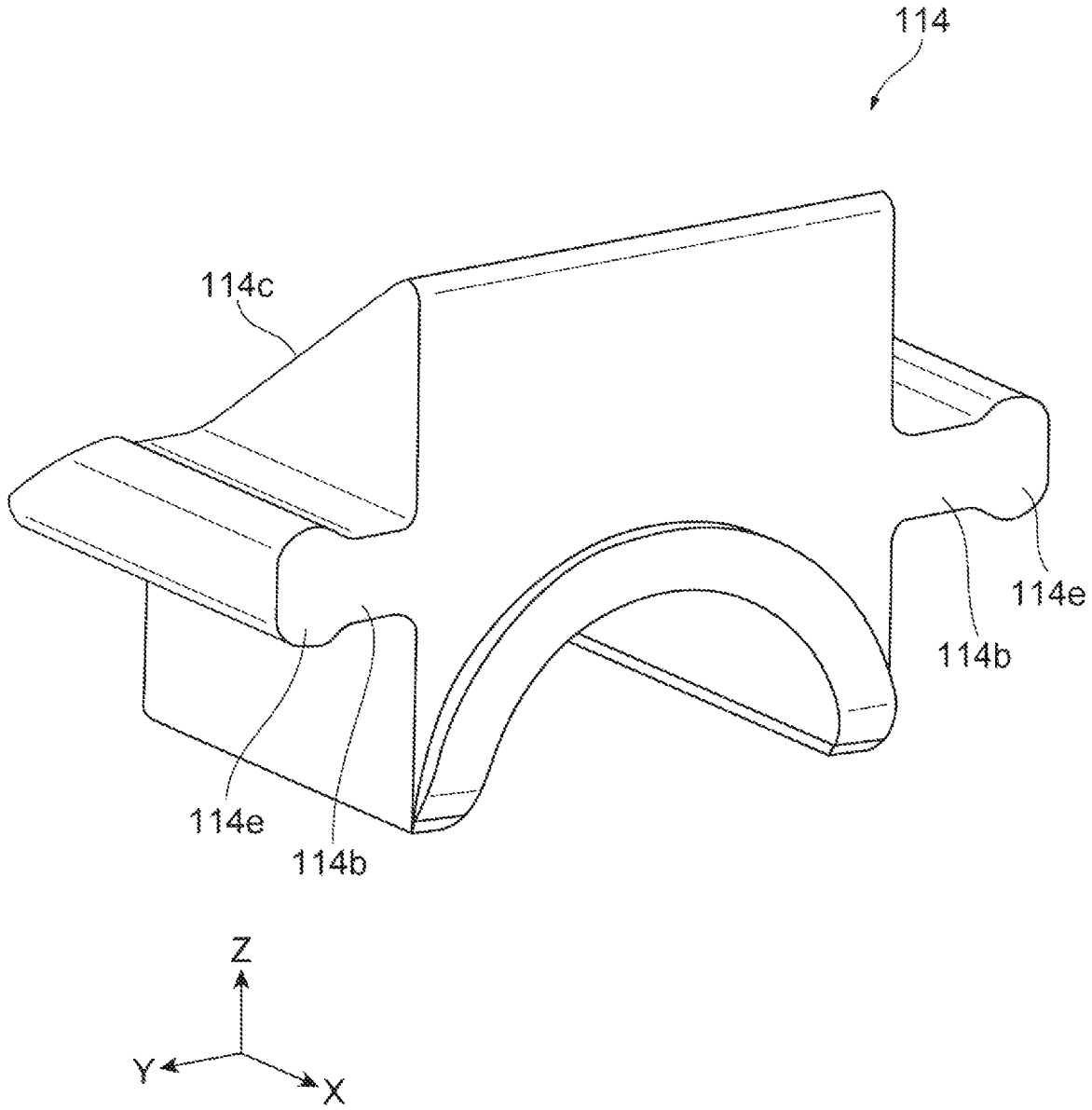
FIG. 8 is a perspective view of another example adjustment member.

FIG. 8 is a perspective view illustrating another example adjustment member. Similar to the adjustment member 14, an adjustment member 114 illustrated in FIG. 8 moves along the longitudinal direction of the stretch roller 2 in response to the movement of the pulley 7, and the pin 15 is moved upward. An upper portion of the adjustment member 114 is provided with an inclined surface 114*c* having the same function as that of the inclined surface 14*c*. A lower portion of the adjustment member 114 is provided with a curved surface that curves to match a contour of the rotary shaft 2*b*. A side portion of the adjustment member 114 is provided with a pair of protrusion pieces 114*b* that protrudes toward both sides in the Y direction. The protrusion piece 114*b* has a plate shape, for example, and extends in the X direction. When viewed from the X direction, a distal end part 114*e* of the protrusion piece 114*b* in the Y direction is formed to have a curved shape with a thickness increasing in the Z direction.

Figure 9:
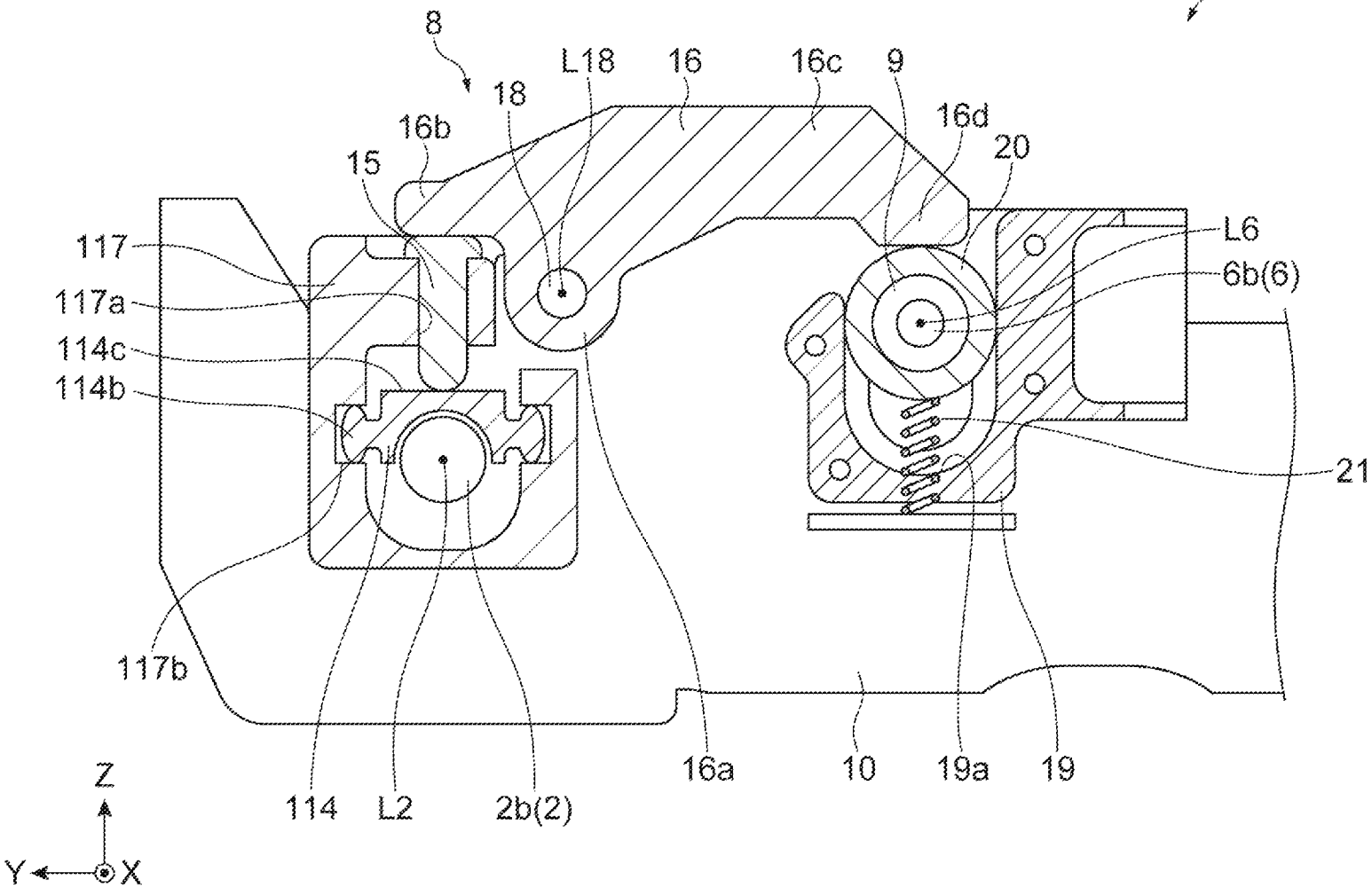
FIG. 9 is a sectional view illustrating another example end structure of a stretch roller.

FIG. 9 is a sectional view illustrating an example end structure of the stretch roller. FIG. 9 illustrates a section of a belt driving device 101 along the YZ plane at the end portion (position at which the pin 15 is cut) of the rotary shaft 2*b*. The example adjustment member 114 is supported by a holding member 117 having a fixed distance from the rotary shaft 2*b*. As illustrated in FIG. 9, the holding member 117 is fixed to the frame 10 that supports the rotary shaft 2*b*. Additionally, the holding member 117 is provided with an opening portion 117*a* that holds the pin 15, similar to the opening portion 17*a*. The holding member 117 illustrated in the drawing has a pair of rails 117*b* that supports the protrusion piece 114*b* of the adjustment member 114. In some examples, the pair of rails 117*b* is continuously formed in the X direction and is recessed to be opposite to each other in the Y direction. In FIG. 9, the rail 117*b* has a recessed rectangular shape in a sectional view. The protrusion pieces 114*b* are accommodated in the rails 117*b*, respectively, and thereby the adjustment member 114 is supported by the pair of rails 117*b*. When the adjustment member 114 is supported by the pair of rails 117*b*, the distal end part 114*e* of the protrusion piece 114*b* formed in the curved shape comes into contact with the rail 117*b*. In some examples, the distal end part 114*e* comes into linear contact with the rail 117*b*. The adjustment member 114 is movable in the X direction in a state of being supported by the pair of rails 117*b*.

When the adjustment member 114 is supported by the pair of rails 117*b*, the lower portion of the adjustment member 114 is spaced apart from the rotary shaft 2*b*. In some examples, a gap is formed between the rotary shaft 2*b* and the curved surface formed on the lower portion of the adjustment member 114 as illustrated in FIG. 9. Therefore, when the adjustment member 114 moves along the longitudinal direction of the stretch roller 2, friction is not generated between the adjustment member 114 and the rotary shaft 2*b*. Accordingly, even when foreign matter such as the toner material intrudes between the adjustment member 114 and the rotary shaft 2*b*, the foreign matter is dropped without staying between the adjustment member 114 and the rotary shaft 2*b*.

The adjustment member 114 is supported by the holding member 117 having a fixed distance from the rotary shaft 2*b*. Therefore, when the distance from the rotary shaft 2*b* is maintained to be constant, the adjustment member 114 may be supported at a position spaced apart from the rotary shaft 2*b*.

In some examples, a contact part of the adjustment member 114 is in linear contact with the holding member 117. Therefore, when the adjustment member 114 moves in the X direction in a state of being held by the holding member 117, friction between the holding member 117 and the adjustment member 114 is reduced.

Figure 10:
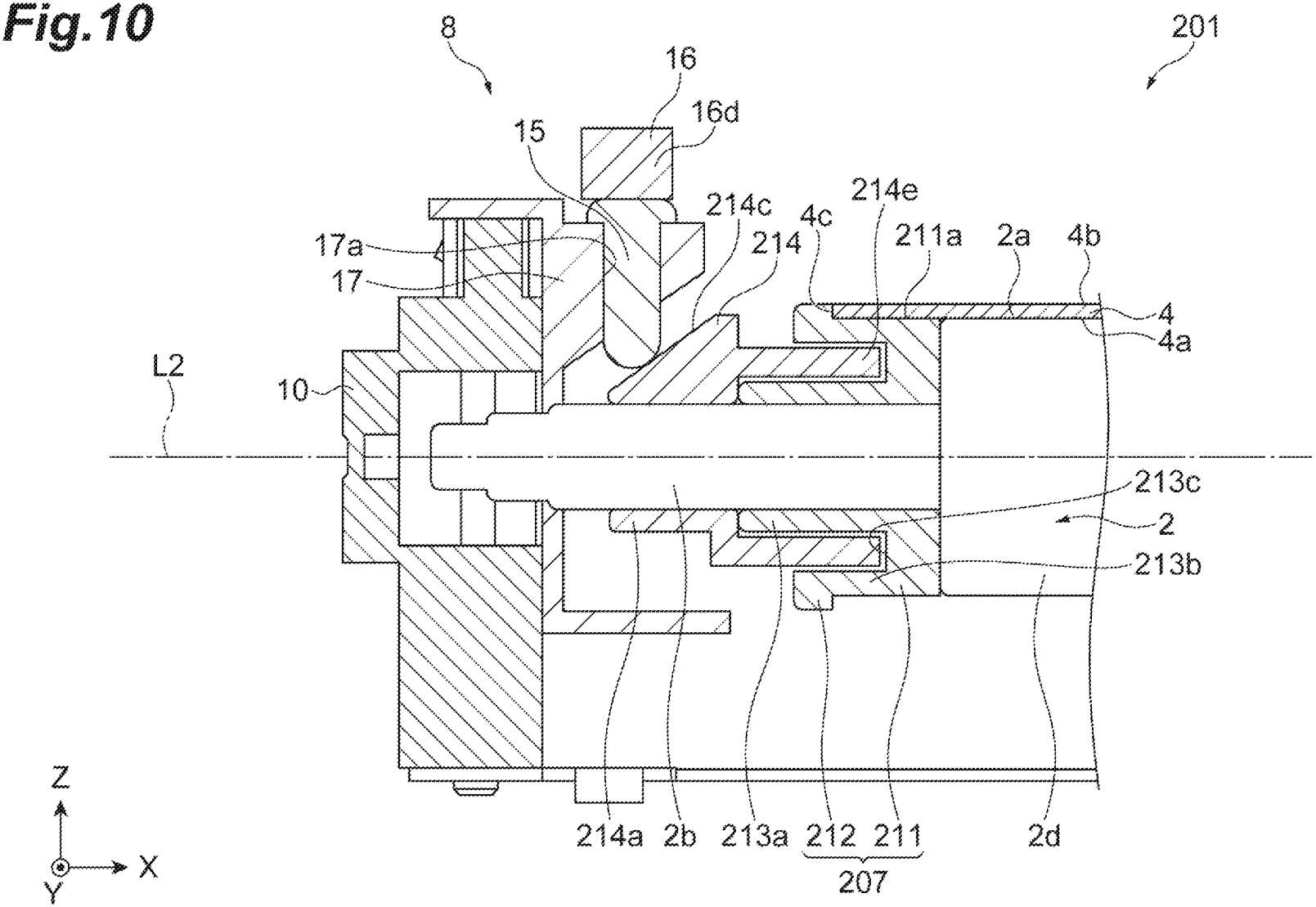
FIG. 10 is a sectional view illustrating still another example end structure of a stretch roller.

FIG. 10 illustrates an example belt driving device including an adjustment member and a pulley. FIG. 10 illustrates a section of a belt driving device 201 along the XZ plane at the position of the axis line L2. As illustrated in FIG. 10, the belt driving device 201 includes a pulley 207 and an adjustment member 214.

The pulley 207 (an example of the positioning member) has a cylindrical portion 211 and a flange portion 212. The rotary shaft 2*b* of the stretch roller 2 is inserted into the pulley 207. The pulley 207 is slidable in the X direction in which the stretch roller 2 extends. An outer diameter of the cylindrical portion 211 is substantially equal to the outer diameter of the roller main body 2*d* of the stretch roller 2. An outer peripheral surface 211*a* of the cylindrical portion 211 and the outer peripheral surface 2*a* of the roller main body 2*d* of the stretch roller 2 are disposed substantially at the same position from the axis line L2 in the radial direction of the stretch roller 2. The outer peripheral surface 211*a* of the cylindrical portion 211 is configured to abut the inner peripheral surface 4*a* of the endless belt 4.

The cylindrical portion 211 is provided with a recessed annular portion 213*c*. The recessed annular portion 213*c* has an annular shape around the axis line L2. The recessed annular portion 213*c* is formed from a surface of the cylindrical portion 211, which faces the adjustment member 214, toward the roller main body 2*d*. A part of the cylindrical portion 211 between the recessed annular portion 213*c* and the rotary shaft 2*b* is a first annular portion 213*a* having an annular shape around the axis line L2. A part of the cylindrical portion 211 on the outer side in the radial direction from the recessed annular portion 213*c* is a second annular portion 213*b* having an annular shape around the axis line L2. In some examples, the first annular portion 213*a* projects closer to the side of the adjustment member 214 than the second annular portion 213*b*, as illustrated in FIG. 10.

The adjustment member 214 is disposed adjacent to the outer side of the pulley 207 in the X direction. The adjustment member 214 has a main body portion 214*a* provided with an opening portion into which the rotary shaft 2*b* is inserted. A top surface of the main body portion 214*a* is formed as an inclined surface 214*c* having the same function as that of the inclined surface 14*c*. The adjustment member 214 moves to the outer side in the X direction in response to the movement of the pulley 207.

The main body portion 214*a* is provided with an engagement portion 214*e* that overlaps the pulley 207 in the X direction. The engagement portion 214*e* has an annular shape around the axis line L2. An inner diameter of the engagement portion 214*e* is larger than an outer diameter of the first annular portion 213*a* formed in the pulley 207. An outer diameter of the engagement portion 214*e* is smaller than an inner diameter of the second annular portion 213*b* formed in the pulley 207. Therefore, when the adjustment member 214 is in contact with the pulley 207, the first annular portion 213*a* is inserted into the inner side of the engagement portion 214*e*, and the engagement portion 214*e* is inserted into the inner side of the second annular portion 213*b*. In some examples, the engagement portion 214*e* is inserted into the inner side of the recessed annular portion 213*c* of the pulley 207.

The adjustment member 214 may be pressed by the distal end of the first annular portion 213*a* on the inner side of the engagement portion 214*e*, thereby, moving in the X direction. In some examples, a part of the surface of the adjustment member 214 on the inner side of the engagement portion 214*e*, the surface facing the pulley 207, and the distal end of the first annular portion 213*a* constitute a contact surface on which the part and the distal end come into contact with each other. The contact surface is covered with the engagement portion 214*e* of the adjustment member 214 in the radial direction of the rotary shaft 2*b*.

In order for the foreign matter such as the toner material to intrude between the adjustment member 214 and the rotary shaft 2*b*, the foreign matter proceeds between an inner peripheral surface of the second annular portion 213*b* and an outer peripheral surface of the engagement portion 214*e* and between an inner peripheral surface of the engagement portion 214*e* and an outer peripheral surface of the first annular portion 213*a*. Therefore, intrusion of the foreign matter between the adjustment member 214 and the rotary shaft 2*b* is suppressed.

Figure 11:
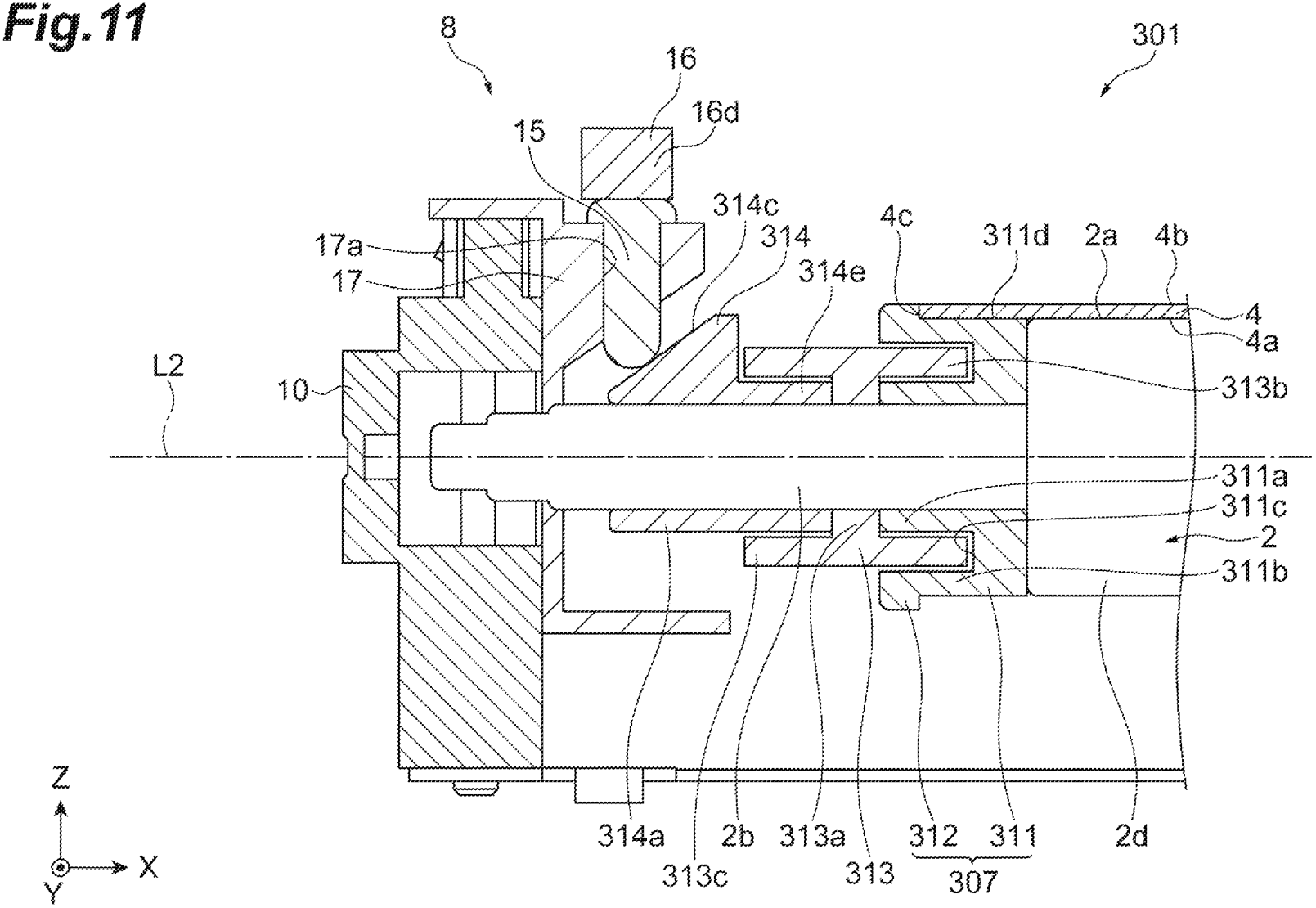
FIG. 11 is a sectional view illustrating a further example end structure of a stretch roller.

FIG. 11 illustrates another example belt driving device including an adjustment member and a pulley. FIG. 11 illustrates a section of a belt driving device 301 along the XZ plane at the position of the axis line L2. In some examples, the belt driving device 301 includes an adjustment member 314, a first pulley 307, and a second pulley 313, as illustrated in FIG. 11. The positioning member may include the first pulley 307 and the second pulley 313.

The first pulley 307 has a cylindrical portion 311 and a flange portion 312. The first pulley 307 is slidable in the X direction in which the stretch roller 2 extends. An outer diameter of the cylindrical portion 311 is substantially equal to the outer diameter of the roller main body 2*d* of the stretch roller 2. An outer peripheral surface 311*d* of the cylindrical portion 311 and the outer peripheral surface 2*a* of the roller main body 2*d* of the stretch roller 2 are disposed substantially at the same position from the axis line L2 in the radial direction of the stretch roller 2. The outer peripheral surface 311*d* of the cylindrical portion 311 is configured to abut the inner peripheral surface 4*a* of the endless belt 4.

The cylindrical portion 311 is provided with a recessed annular portion 311*c*. The recessed annular portion 311*c* has an annular shape around the axis line L2. The recessed annular portion 311*c* is formed from a surface of the cylindrical portion 311, which faces the adjustment member 314, toward the roller main body 2*d*. A part of the cylindrical portion 311 between the recessed annular portion 311*c* and the rotary shaft 2*b* is a first annular portion 311*a* having an annular shape around the axis line L2. A part of the cylindrical portion 11 on the outer side in the radial direction from the recessed annular portion 311*c* is a second annular portion 311*b* having an annular shape around the axis line L2.

The second pulley 313 is disposed further on the outer side than the first pulley 307 in the X direction. The second pulley 313 is provided with a cylindrical portion 313*a*, an inner annular portion 313*b*, and an outer annular portion 313*c*. The cylindrical portion 313*a* is provided with an opening portion into which the rotary shaft 2*b* is inserted. An outer diameter of the cylindrical portion 313*a* is smaller than an inner diameter of the second annular portion 311*b*. The inner annular portion 313*b* has an annular shape around the axis line L2 and projects from the cylindrical portion 313*a* to a side of the first pulley 307. An outer diameter of the inner annular portion 313*b* is smaller than an inner diameter of the second annular portion 311*b*, and an inner diameter of the inner annular portion 313*b* is larger than an outer diameter of the first annular portion 311*a*. The outer annular portion 313*c* has an annular shape around the axis line L2 and projects from the cylindrical portion 313*a* to a side of the adjustment member 314.

The adjustment member 314 is disposed further on the outer side than the second pulley 313 in the X direction. The adjustment member 314 has a main body portion 314*a* provided with an opening portion into which the rotary shaft 2*b* is inserted. A top surface of the main body portion 314*a* is formed as an inclined surface 314*c* having the same function as that of the inclined surface 14*c*. The adjustment member 314 moves in the X direction in response to the movement of the first pulley 307 and the second pulley 313.

The main body portion 314*a* is provided with an engagement portion 314*e* that overlaps the second pulley 313 in the X direction. The engagement portion 314*e* has an annular shape around the axis line L2. An inner diameter of the engagement portion 314*e* is substantially equal to the opening portion of the main body portion 314*a*. An outer diameter of the engagement portion 314*e* is smaller than an inner diameter of the outer annular portion 313*c* formed in the second pulley 313. When the adjustment member 314 is in contact with the second pulley 313, the engagement portion 314*e* is inserted into the inner side of the outer annular portion 313*c*.

As an example, the cylindrical portion 313*a* is pressed by a distal end of the first annular portion 311*a* of the first pulley 307, and thereby the second pulley 313 moves along the X direction. An end portion of the engagement portion 314*e* is pressed by the cylindrical portion 313*a*, and thereby the adjustment member 314 moves in the X direction. Contact surfaces of the adjustment member 314 and the second pulley 313 and contact surfaces of the second pulley 313 and the first pulley 307 are covered with the second pulley 313 in the radial direction of the axis line L2.

In order for the foreign matter such as the toner material to intrude between the adjustment member 314 and the rotary shaft 2*b*, the foreign matter proceeds between an inner peripheral surface of the outer annular portion 313*c* and an outer peripheral surface of the engagement portion 314*e*. Therefore, intrusion of the foreign matter between the adjustment member 314 and the rotary shaft 2*b* is suppressed.

In addition, in order for the foreign matter to intrude between the first pulley 307 and the rotary shaft 2*b*, the foreign matter proceeds between an inner peripheral surface of the second annular portion 311*b* and an outer peripheral surface of the inner annular portion 313*b* and between an inner peripheral surface of the inner annular portion 313*b* and an outer peripheral surface of the first annular portion 311*a*. Therefore, intrusion of the foreign matter between the first pulley 307 and the rotary shaft 2*b* is suppressed.

Figure 12:
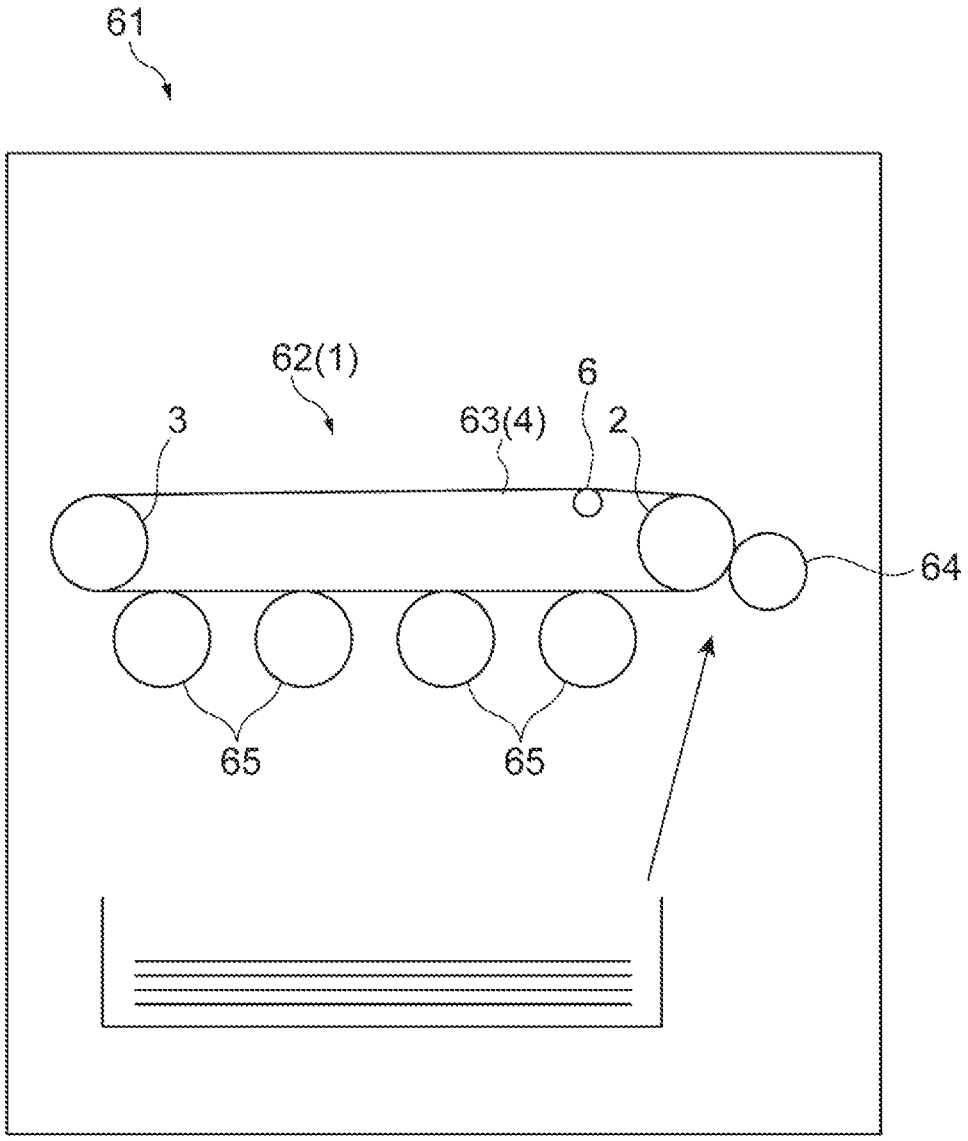
FIG. 12 is a schematic diagram illustrating an example image forming apparatus including an intermediate transfer unit.

An example color image forming apparatus including the intermediate transfer is described with reference to FIG. 12. As illustrated in FIG. 12, a color image forming apparatus 61 includes an intermediate transfer unit 62. The intermediate transfer unit 62 (e.g., belt driving device 1) has the stretch roller 2, the stretch roller 3, the steering roller 6, an intermediate transfer belt 63 which is an endless belt, and a secondary transfer roller 64. The secondary transfer roller 64 is disposed to cause a sheet which is a recording medium to come into press contact with the intermediate transfer belt 63 (e.g., endless belt 4) that moves along the stretch roller 2. The color image forming apparatus 61 has various configurations of a photoconductor 65 and the like which may be used for an image forming apparatus. A plurality of photoconductors 65 are disposed along a movement direction of the intermediate transfer belt 63.

A toner image formed on the photoconductor 65 is initially transferred to the intermediate transfer belt 63. The initially transferred image is secondarily transferred to a sheet that is caused to come into pressure contact with the secondary transfer roller 64. The toner image secondarily transferred to the sheet may be fixed by a fixing device. In addition, the intermediate transfer unit 62 may include a cleaning blade for removing toner that is attached to the intermediate transfer belt 63 and remains. The cleaning blade comes into pressure contact with the intermediate transfer belt 63 so as to remove remaining toner.

A color image forming apparatus 61 which includes the belt driving device 1 may be used to prevent a misalignment of the intermediate transfer belt 63 in the width direction. In the intermediate transfer unit 62, deformation such as waviness of the intermediate transfer belt 63 is also prevented from occurring. Therefore, the distance between the cleaning blade and the intermediate transfer belt 63 may be kept substantially uniform or constant. Thus, the remaining toner may be removed appropriately to maintain image quality.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. A belt driving device comprising:

an endless belt;

a stretch roller to engage the endless belt, the stretch roller including a rotary shaft;

a steering roller spaced apart from the stretch roller and located within the endless belt;

an adjustment member located along the rotary shaft of the stretch roller, the adjustment member to move along the rotary shaft; and a linking mechanism to couple the adjustment member to the steering roller, the linking mechanism to engage a contact surface of the adjustment member, wherein the contact surface of the adjustment member includes contact points positioned at different distances from the rotary shaft to raise the linking mechanism during movement of the adjustment member, to cause the steering roller to tilt at an angle, and to maintain an alignment of the endless belt.

2. The belt driving device according to claim 1, wherein the adjustment member includes a slit through which at least a portion of the rotary shaft is exposed.

3. The belt driving device according to claim 2, wherein at least a lower portion of the rotary shaft in a vertical direction is exposed through the slit.

4. The belt driving device according to claim 2, wherein the adjustment member has a bearing surface that surrounds the rotary shaft, and wherein the bearing surface is provided with a support surface that is in contact with the rotary shaft and a recessed surface that is spaced apart from the rotary shaft.

5. The belt driving device according to claim 2, further comprising:

a collecting portion that is formed below the adjustment member and is opened toward the slit.

6. The belt driving device according to claim 2, wherein a movable length of the adjustment member in a longitudinal direction of the stretch roller is longer than a width of a frame portion that surrounds the slit in the adjustment member.

7. The belt driving device according to claim 1, wherein the adjustment member is provided with a discharge port to discharge foreign matter between the rotary shaft and the adjustment member.

8. The belt driving device according to claim 1, wherein the adjustment member is spaced apart from the rotary shaft.

9. The belt driving device according to claim 8, wherein the adjustment member is supported by a frame at a fixed distance from the rotary shaft.

10. The belt driving device according to claim 9, wherein the adjustment member has a contact part that comes into linear contact with the frame.

11. The belt driving device according to claim 1, further comprising:

a positioning member located adjacent the adjustment member along the rotary shaft, wherein the adjustment member including an engagement portion that overlaps the positioning member.

12. The belt driving device according to claim 11, wherein the engagement portion of the adjustment member has an annular shape around an axis line of the rotary shaft, wherein the positioning member has an annular portion around the axis line of the rotary shaft, and wherein the annular portion is inserted into an inner side of the engagement portion.

13. The belt driving device according to claim 11, wherein the engagement portion of the adjustment member has an annular shape around an axis line of the rotary shaft, wherein the positioning member has an annular portion around the axis line of the rotary shaft, and wherein the engagement portion is inserted into an inner side of the annular portion.

14. The belt driving device according to claim 11, wherein the engagement portion of the adjustment member has an annular shape around an axis line of the rotary shaft, wherein the positioning member has a recessed annular portion around the axis line of the rotary shaft, and wherein the engagement portion is inserted into an inner side of the recessed annular portion.

15. An image forming apparatus comprising:

a belt driving device, wherein the belt driving device includes:

an endless belt;

a stretch roller to engage with the endless belt, the stretch roller including a rotary shaft;

a steering roller that is spaced apart from the stretch roller on an inner side of the endless belt;

an adjustment member that is disposed along the rotary shaft of the stretch roller, the adjustment member to move along the rotary shaft; and a linking mechanism that connects the adjustment member and the steering roller, the linking mechanism to engage with a contact surface of the adjustment member, and wherein the contact surface is provided with contact points that are positioned at different distances from the rotary shaft such that, during movement of the adjustment member, the linking mechanism is lifted, and the steering roller tilts so as to maintain a disposition of the endless belt relative to the steering roller.

* * * * *